United States Patent [19]

Logan

[11] 4,354,437

[45] Oct. 19, 1982

[54] SUPPORT STRUCTURE FOR FOLDING TABLES AND LIKE STRUCTURES

[76] Inventor: William F. Logan, 70-72 Laight St., New York, N.Y. 10013

[21] Appl. No.: 106,307

[22] Filed: Dec. 21, 1979

[51] Int. Cl.[3] ..... A47B 3/06

[52] U.S. Cl. ..... 108/153; 108/128; 248/188.91

[58] Field of Search ..... 108/153, 157, 156, 154, 108/128; 248/165, 188.91; 297/440, 441, 16

[56] References Cited

U.S. PATENT DOCUMENTS

| | | | |
|---|---|---|---|
| 1,134,057 | 3/1915 | Neff | 108/128 |
| 1,181,712 | 5/1916 | Wittliff | 248/188.91 |
| 1,820,589 | 8/1931 | Wittliff | 248/188.91 |
| 2,139,673 | 12/1938 | Draper | 108/128 |
| 2,713,529 | 7/1955 | Herrschaft | 108/154 |
| 3,295,475 | 1/1967 | McClellan | 108/153 |
| 4,148,520 | 4/1979 | Miller | 297/441 |

FOREIGN PATENT DOCUMENTS

| | | | |
|---|---|---|---|
| 1210617 | 10/1959 | France | 108/157 |
| 1424550 | 12/1965 | France | 108/157 |

*Primary Examiner*—Francis K. Zugel
*Attorney, Agent, or Firm*—Ladas & Parry

[57] ABSTRACT

A folding table or like structure having a generally planar top supported on the floor by four or more legs, a support structure comprising: two points of articulation under the underside of the table top located at some distance inward from the edge of the table; two splayed legs in V-formation extending from each point of articulation to a point on the floor approximately vertically below the corner of the table top; a cable network interconnecting the lower ends of said legs; and a second series of cables extending from each corner of the table top to the lower end of the leg located below the respective corner, the arrangement being such that in the assembled state all cables are in tension and the legs are in compression.

19 Claims, 13 Drawing Figures

SUPPORT STRUCTURE FOR FOLDING TABLES AND LIKE STRUCTURES

This invention relates to a folding table or similar collapsible structures having a generally flat top, rectangular in outline and four collapsible legs which can be readily folded against the underside of the table.

BRIEF SUMMARY OF THE INVENTION

I provide in a folding table or like structures having a generally planar top supported on the floor by multiple legs, a support structure comprising:

(1) multiple points of articulation located below the table top at some distance inward from the edge of the table;

(2) two splayed legs or struts in V-formation extending each from each point of articulation to points on the floor approximately vertically below the corners of the table top;

(3) a cable network interconnecting the lower ends of said legs or struts and extending from each corner of the table top to the lower end of the leg located below the respective corner, the arrangement being such that in the assembled state all cables are in tension and the legs or struts are in compression.

In its tensioned condition, the lower system of cables forms a planar support so that the table structure can be put on soft ground or sand without loss of stability, the weight of the table being carried by the cables. On release of the tension means, the legs can be collapsed against the underside of the table top. The assembly is then reduced to a flat volume.

The elements of the table support structure are arranged in such a way that the top is prevented from twisting, swaying or moving vertically by the triangulations formed between the support struts, the top and the tension members. In order for the top to remain stable over time in spite of small changes in length of the tension members due to creep or temperature changes a spring element must be introduced into the system. In one form of the invention there is a coil spring situated adjacent to the prestressing means. The spring may be placed anywhere in the table support structure. In another embodiment, the spring may be the cambered table top itself, or in a still further embodiment the spring may be part of the strut elements.

One particular advantage of this type of table structure is that it may be easily and compactly disassembled for storage or shipment. This is done by releasing a prestressing device so that the tension elements become slack and the legs or struts may be displaced from their normal position to one in which they lie flat against the table top. The flexible tension members may also be placed flat against the top for the same reasons.

DETAILED DESCRIPTION OF THE DRAWINGS

Figure 1:
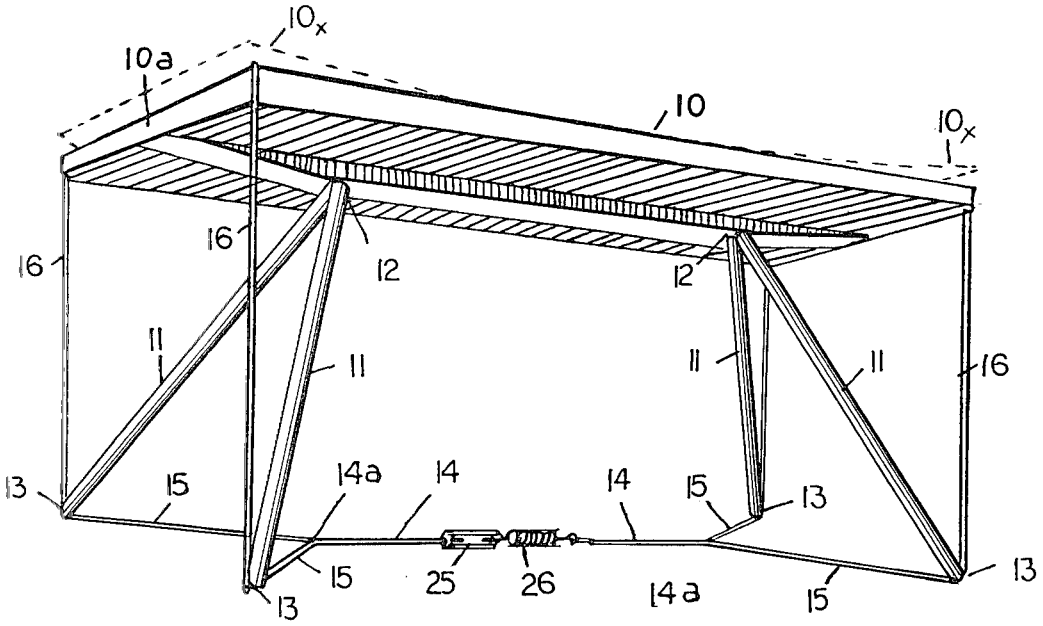
FIG. 1 shows a perspective underside view of an assembled table according to the invention in which the cable network interconnecting the lower ends of the legs forms a double Y.
Figure 2:
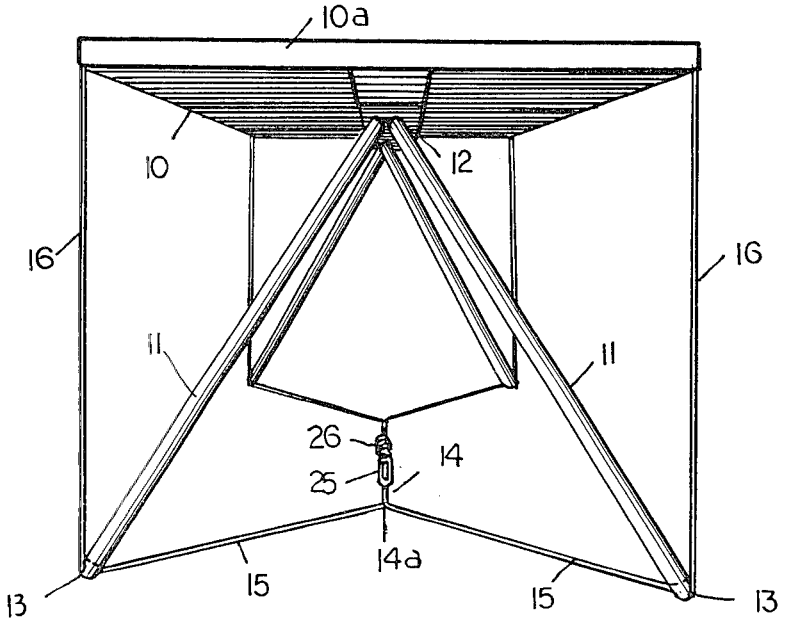
FIG. 2 shows the same table in a perspective end view.

Referring first to FIGS. 1 and 2 of the drawings, the folding table of the invention includes a generally planar table top 10. In its preferred form, the table top is rectangular. The table top may also be oval, or even square or round.

The table top can be made from plywood, laminated wood or plastic, fiberglass or steel or other material which has sufficient strength whilst being capable of holding a precamber and will not break when flexed against the precamber or bow under tension of the cables.

The top is supported at each end by a pair of splayed legs or struts 11, coming together at the top at a point of articulation 12.

The points of articulation are preferably located inwards from the narrow ends **10*a*** of the table top by a distance which is approximately equal to one sixth of the total length of the table top.

The lower ends 13 of the legs 11 rest on the floor. The four table legs are all identical in structure. They are preferably made of steel tubing about 33 inches in length so that in its assembled state the height of the table will be the usual 29 inches above floor level.

The lower ends 13 of the legs are interconnected by a network of cables in the form of a double Y. The central member 14 of the double Y rests on the floor and extends vertically below the longitudinal axis of the table top. The ends of the central member 14 are each joined at points **14*a* to shorter end cables 15 which in turn are suitably joined to the lower ends 13 of the table legs. The joints 14*a* of cables 14 and 15 forming the points of the Y lie vertically below the points of articulation 12. The shorter cables 15 also rest on the floor and are generally in the same plane as the central member 14**. This lower plane is parallel to and substantially co-extensive with the plane of the table top.

Figure 3:
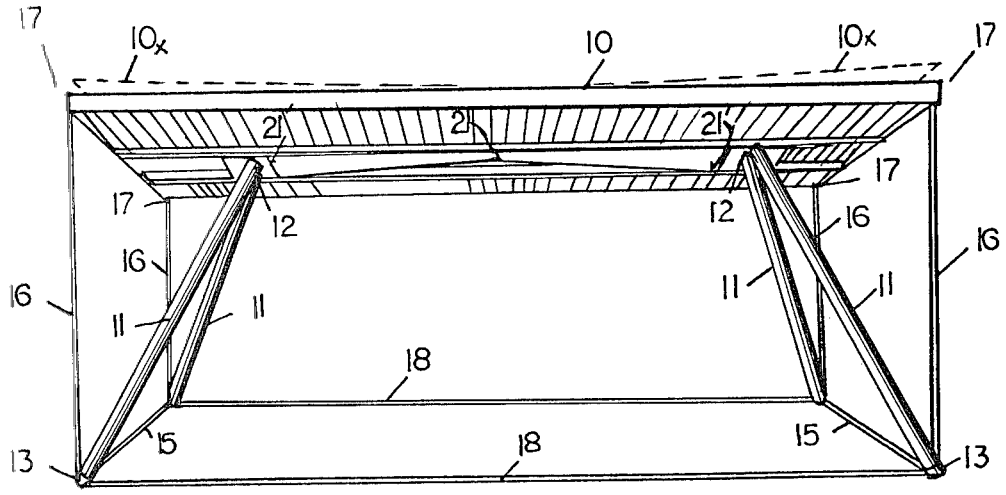
FIG. 3 shows a modified arrangement for the lower cables.

In the modified arrangement of FIG. 3, the lower network of cables 18 is in the form of a rectangle extending between the lower ends of the table legs.

The assembly is completed by vertical cables 16 extending from each corner 17 of the table top to the lower end 13 of the corresponding table leg 11. The vertical cables 16 may be in one piece with the shorter end cables 15 and run through a suitable opening or ferrule or a grooved passage located at the lower leg ends 13. In this manner, a series of triangles are formed at each corner with the longer sides constituted by legs 11 and vertical cables 16. The shorter sides of each of these triangles is constituted by a line running from the corners 17 of the table top to the points of articulation 12.

The advantage of having the cables interconnecting the lower ends of the legs in the formation of a double Y is that the person or persons sitting at the table have greater freedom to move their legs and the legs of the chair will not interfere with the cables. The form shown in FIGS. 1 and 2 is thus more suitable as a dining room table. However, much the same effect is obtained by arranging the lower cables 18 in the form of a rectangle as shown in FIG. 3; this embodiment being more suitable as a coffee table. FIG. 3 also makes it clear how the space between the table top, lower cables 18 and vertical cables 16 defines a rectangular parallelepiped or brick-shaped volume which imparts to the whole structure great strength.

The cables are placed under tension by a pre-stressing device which can be in the form of a turn buckle 25 and spring means 26. This spring compensates for small changes in length of the tension cable due to creep or temperature changes. In the FIGS. 1 and 2 embodiments, the spring 26 is situated in the central member 14 adjacent to the turn buckle or other pre-stressing means. However, the springs may be placed anywhere along the tension cables, or several springs may be used where the cable is in several parts.

When the table top is pre-cambered or bowed with the shorter ends 10*a* pointing upwards in the unstressed state, the tension imparted in this way to the cables may be adequate and the spring elements could be omitted.

When the cables are under tension, the legs 11 are under compression and act as struts. When stressed, the triangles formed at each corner by legs 11 and vertical cables 16 impart to the whole structure a great deal of firmness preventing the table structure from twisting, swaying or moving vertically.

Figure 4:
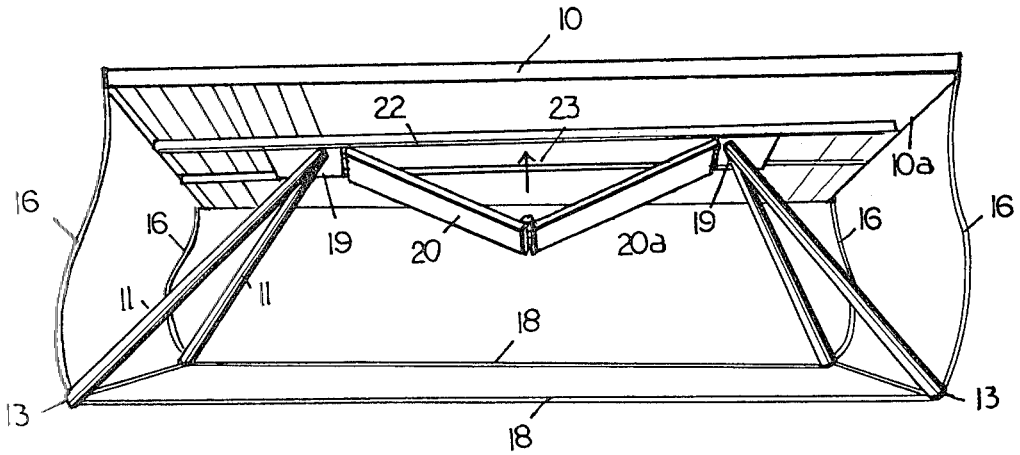
FIG. 4 is a perspective view from underneath showing the manner in which the points of articulation can be moved along the underside of the table.

In the FIG. 1 embodiment, the turn buckle 25 or quick force release device (such as a Pelican hook) can incorporate a quick release for the pre-stressing device. This quick release device may be like the lever action in a ski binding. By releasing the pre-stressing device, the tension elements become slack (as shown in FIG. 4) and the legs may be displaced from their normal position to one in which they lie flat against the underside of the table 10. The table can then be stored away occupying very little space.

Figure 6:
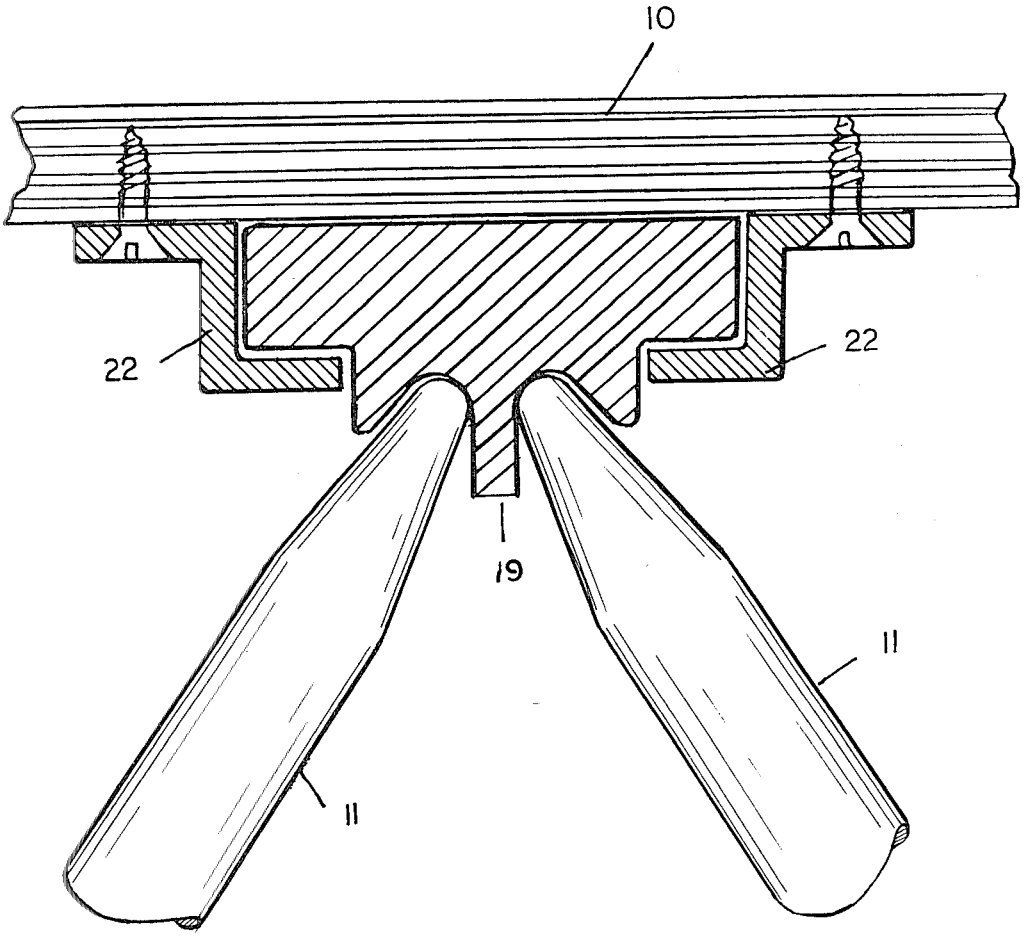
FIG. 6 is a sectional end view of the tracks along which the points of articulation can be moved, taken along line IV—IV in FIG. 4.

In the arrangement shown in FIGS. 3 and 4, the upper ends of the table legs come together at pin joints 19 which are located at the outer ends of slats 20, 20*a* which in turn are joined by hinges 21' to sliding pin joint plate 19. The inner ends of the slats are movably joined together by a hinge 21. The slats move in U-shaped guides 22 fastened to the underside of the table top, see FIG. 6.

Figure 5:
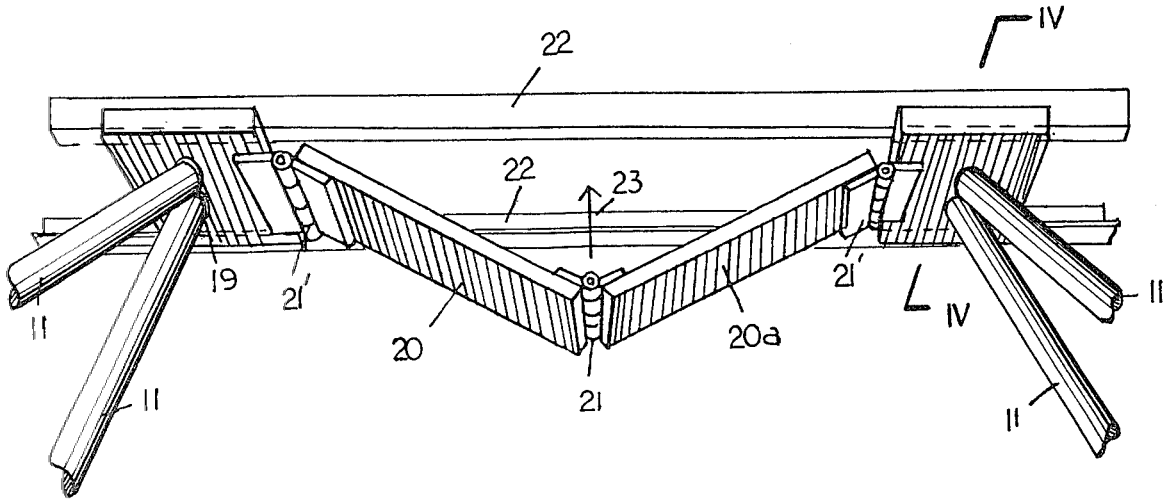
FIG. 5 shows a detail view to a larger scale of part of FIG. 4 slightly modified.

It will be seen that by manually pushing the hinge 21 upwardly against the underside of the table top in the direction of arrow 23 (see FIGS. 4 and 5), the upper ends of the table legs will be moved away from each other. In this manner, the vertical cables 16 and the lower network of cables 14, 15 or 18 will be placed under tension.

To collapse the table, the procedure is reversed and all that is required to release the tension in the cables is to manually move hinge 21 downwardly. To hold the slats 20, 20*a* in the upper position, a simple catch or latch (not shown) can be provided on the underside of the table top. Or a preferred way is to use an overcenter hinge, so that hinge 21 in the tensioned state lies against the underside of the table top over the horizontal plane of hinges 21', see FIG. 3.

The table top 10 in its untensioned state may have an in-built camber, bow or concavity with the ends of the table top above its center. The camber 10*x* (shown in broken lines in FIGS. 1 and 3) can be quite slight and does not amount to more than 1 or 2 inches in a 6 foot table. However, in this manner, on applying tension to the vertical cables 16, the table top will be flexed in the opposite direction so that in the tensioned state, the table top will generally be quite flat in its horizontal plane. The camber will thus compensate for changes in length in the cables due to temperature variations or wear and the spring 26 can be omitted.

Another manner of moving apart the points of articulation is to arrange the pin joints 19 (holding together the upper ends of the splayed legs 11) on female threaded slides which move in U-shaped guides mounted on the underside of the table top. A spindle with opposed threads on its ends engage in these slides. The spindle has a square end adapted to be engaged by a crank (not shown).

Figure 7:
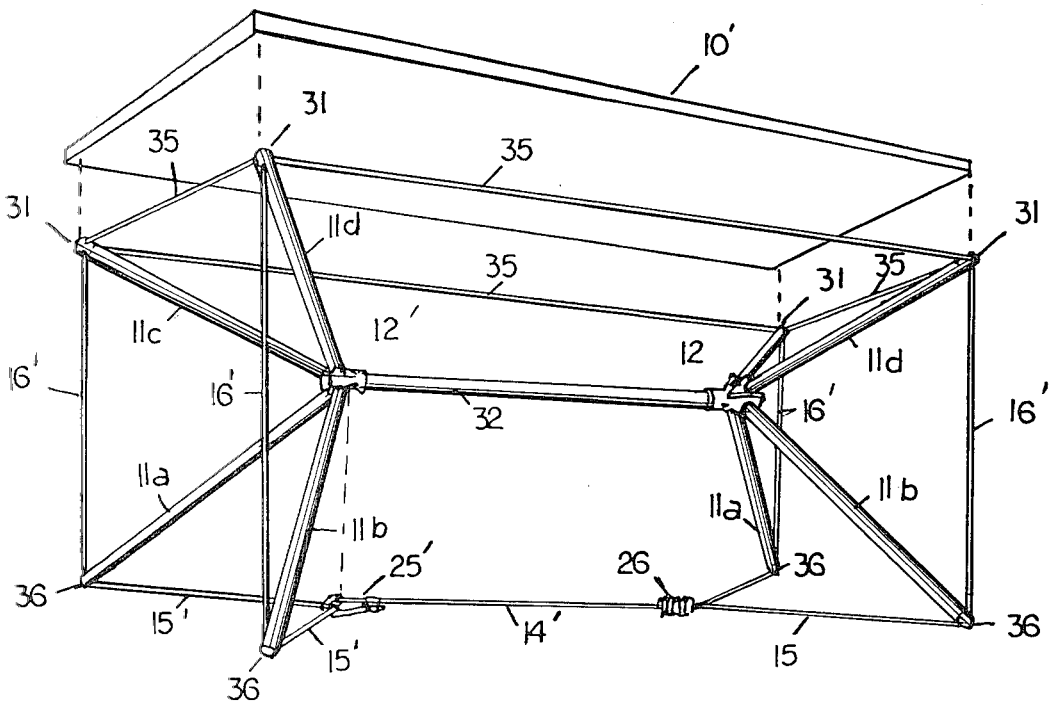
FIG. 7 is a perspective view of a modified version in which the table top loosely rests on a stressed framework.

In the FIG. 7 modification, the table top 10' sits loosely on the supporting framework formed by the cables and struts. In this system, the supporting frame takes all stresses and strains and the table top 10 may be made from plate glass, marble or other rigid material.

The supporting framework includes two points of articulation 12' located below the underside of the table top approximately midway between the plane of the table top and the floor. The points of articulation are again located inwardly from the shorter end of the table top by a distance which is roughly equal to one sixth (1/6) of the total length of the table.

Two pairs of splayed legs or struts 11*a*–11*b*, 11*c*–11*d* in V-formation extend from each point of articulation 12'. Legs 11*a*–11*b* form the lower pair extending from the point of articulation to the floor.

Struts 11*c*–11*d* form the upper pair. The ends of the upper struts at either end of the table form four supporting points 31 for the loose table top 10'. The points of articulation 12' are held together by a horizontal bar 32 located vertically below the longer axis of the table top.

Figure 11:
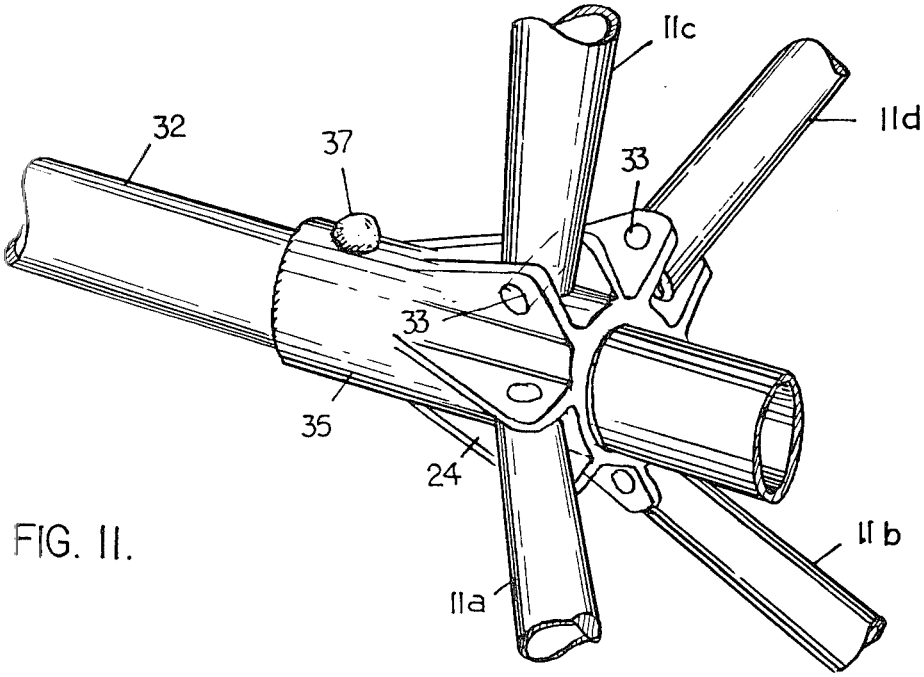
FIGS. 11 and 12 show detailed views to an enlarged scale of the points of articulation for two or three pairs of splayed legs.

The manner in which the legs or struts 11*a*–11*d* and the horizontal bar 32 are articulated together is shown to a larger scale in the detailed view of FIG. 11. The inner end of each leg 11*a*–11*d* carries opposed posts 33 held between twin sets of bearing lugs 24. Four of these sets of bearing lugs are arranged around a central sleeve 35. The upper legs may be shorter than the lower legs so that the horizontal bar will occupy a position which is closer to the underside of the table top than the floor. Such slight variations in length of the legs or struts and their angular disposition may be dictated by aesthetic or structural considerations, but will not affect the basic stability and function of the supporting structure.

37 represents a spring catch with which sleeve 35 is detachably secured in place on horizontal bar 32.

The upper free ends 31 of legs 11*c*–11*d* are joined by straight runs of an upper cable 35 which follows a generally rectangular outline.

The lower corners 36 with which the lower legs or struts 11*a* and 11*b* rest on the floor are joined by a network of cables 14', 15' in the form of a double Y which is similar to the tension cables described and shown in FIGS. 1 and 2. Or the lower network of cables could have the rectangular configuration shown in FIG. 3.

The upper ends 31 and lower ends 36 of the legs or struts are joined by vertical cables 16'. The cables pass through holes or ferrules or grooves at the end of the legs, as previously described. The cables 14', 15', 16' and 35 may be run through ends 31 and 36 along different routes which will readily suggest themselves to the designer.

As in the FIG. 1 embodiment, a quick force release or quick tensioning device 25' is located at a suitable point or points in the cable network, preferably at a point along central member 14'. The central member may (but need not) include a spring 26 to take up slack in the cables.

The arrangement shown in FIG. 7 has the disadvantage that if a heavy load is placed in the middle of table top 10', this may flex downwardly and the table is subject to swaying. To overcome this, in the embodiment shown in FIG. 8, an additional pair of struts 38, 39 in V-formation is joined to struts 11*a*–11*d*.

Figure 8:
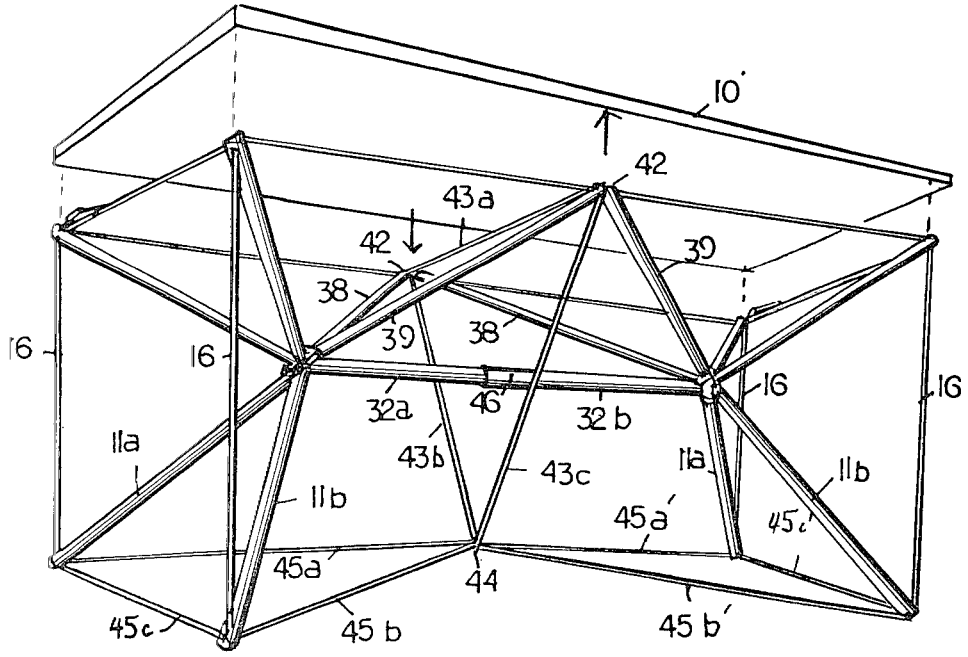
FIG. 8 is a similar view of a further modification with a loose table top.
Figure 12:
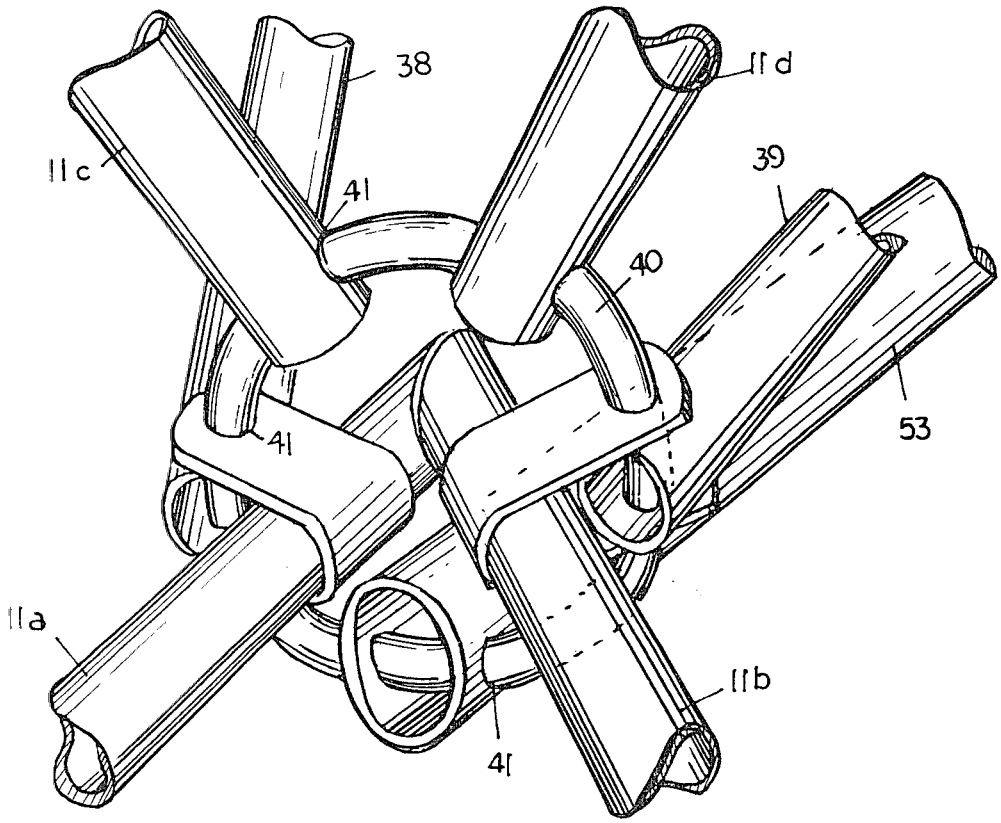

FIG. 12 shows to an enlarged scale the manner in which the three pairs of struts in the FIG. 8 embodiment are all held together at each point of articulation. This is accomplished by means of a split ring 40 which is threaded through openings 41 at the inner end of each strut.

Struts 38, 39 at their upper or outer ends are joined at points 42 to the corresponding ends of the struts rising upwardly from the other point of articulation. The run of the upper cable 35 along the longer side of the table passes at point 42 through openings in the abutting upper ends of these struts. The assembly is completed by a triangle of cables 43*a*–43*b*–43*c* with the lower apex 44 joined to triangular ground cables 45*a*, 45*b*, 45*c* running through the lower ends of struts 11*a*, 11*b*.

In this fashion, the ends of six cables, 43*c*, 43*b*, 45*a*, 45*b*, 45*a'* and 45*b'* come together at apex point 44 which is preferably located about 4" above floor level. It will be seen that if in this embodiment a load is applied to the middle of the table top along the line joints points 42, any tendency to rotate the structure out of true will be resisted by struts 38, 39 and the triangular network of cables linked therewith.

In the FIG. 8 embodiment the horizontal bar may be in two pieces 32*a*, 32*b* one sliding telescopically within the other. A spring catch or umbrella snap 46 secures bars 32*a*, 32*b* at the desired spacing.

Figure 9:
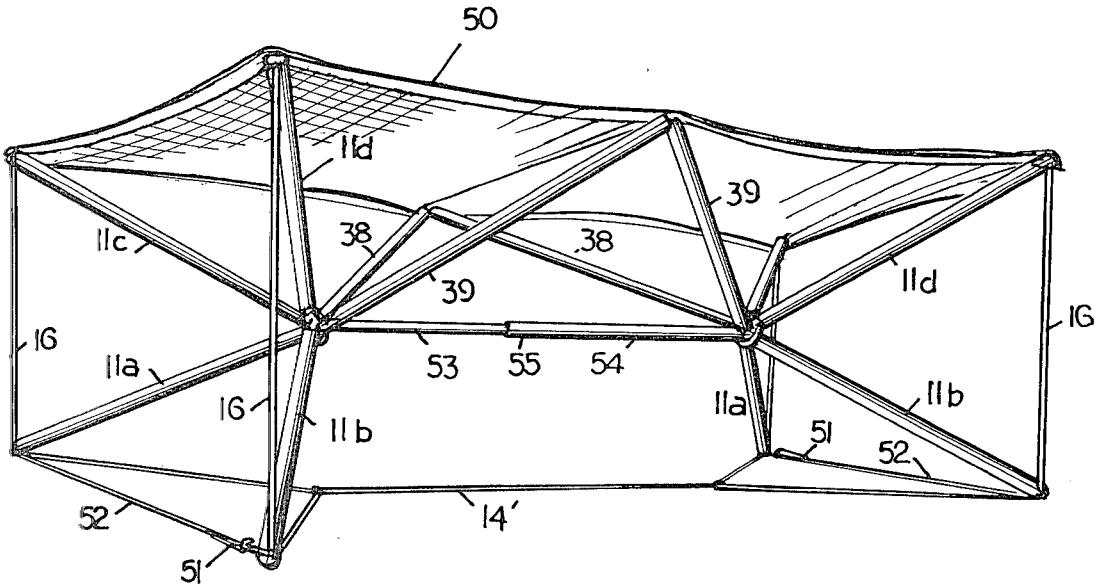
FIG. 9 is a perspective view of yet another modification of a folding structure incorporating a stretched canvas top.
Figure 10:
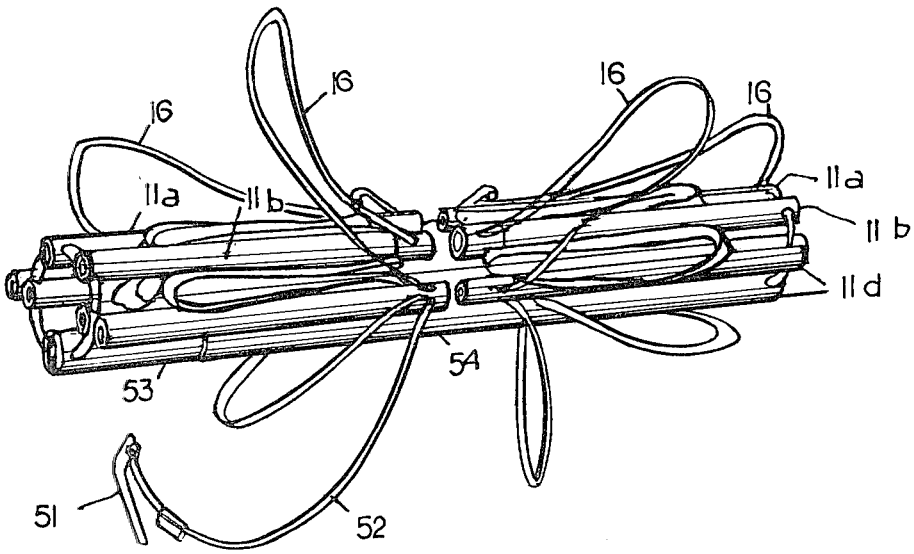
FIG. 10 shows the folding structure of FIG. 9 collapsed into a bundle.

The folding structure shown in FIGS. 9 and 10 uses a generally rectangular canvas top 50 which is stretched between the upper ends of struts 11*c*, 11*d* and 38, 39 reaching upwardly from each point of articulation. The term "canvas" top includes any suitable woven or other sheet material or mesh. The "canvas" top thus combines the supporting function of table top 10 and the tensioning action of the upper cables 35 in the FIGS. 7 and 8 embodiments. The edge of the canvas 50 under tension will assume the flat catinary shape shown in FIG. 9. A quick force release device 51 is located in one of the lower cables 52 which interconnects the lower ends of lower legs 11*a*, 11*b*. The lower cable 52 may follow the double Y of FIG. 7 or the cables could have the rectangular configuration shown in FIG. 3. The system of struts and cables could also follow the FIG. 8 configuration, where the upper horizontal cables could be replaced by a "canvas" top.

The arrangement of the legs or struts is similar to the FIG. 8 embodiment. The horizontal strut is again in two parts 53, 54 telescopically sliding within each other and held together by an umbrella type snap 55.

To collapse the structure, the quick release device 51 and the umbrella snap are disengaged. The legs are folded towards each other. The upper ends of the upper struts need not be disengaged from the canvas which folds up between the legs as shown in FIG. 10. The folded bundle occupies approximately 2% of the space of the structure in its assembled state shown in FIG. 9.

Because of the small storage space required, the folding structure of FIGS. 9 and 10 may find use as a camp bed or scaled upwardly could form part of a tent, water catchment or other military or strategic uses might suggest themselves.

Figure 13:
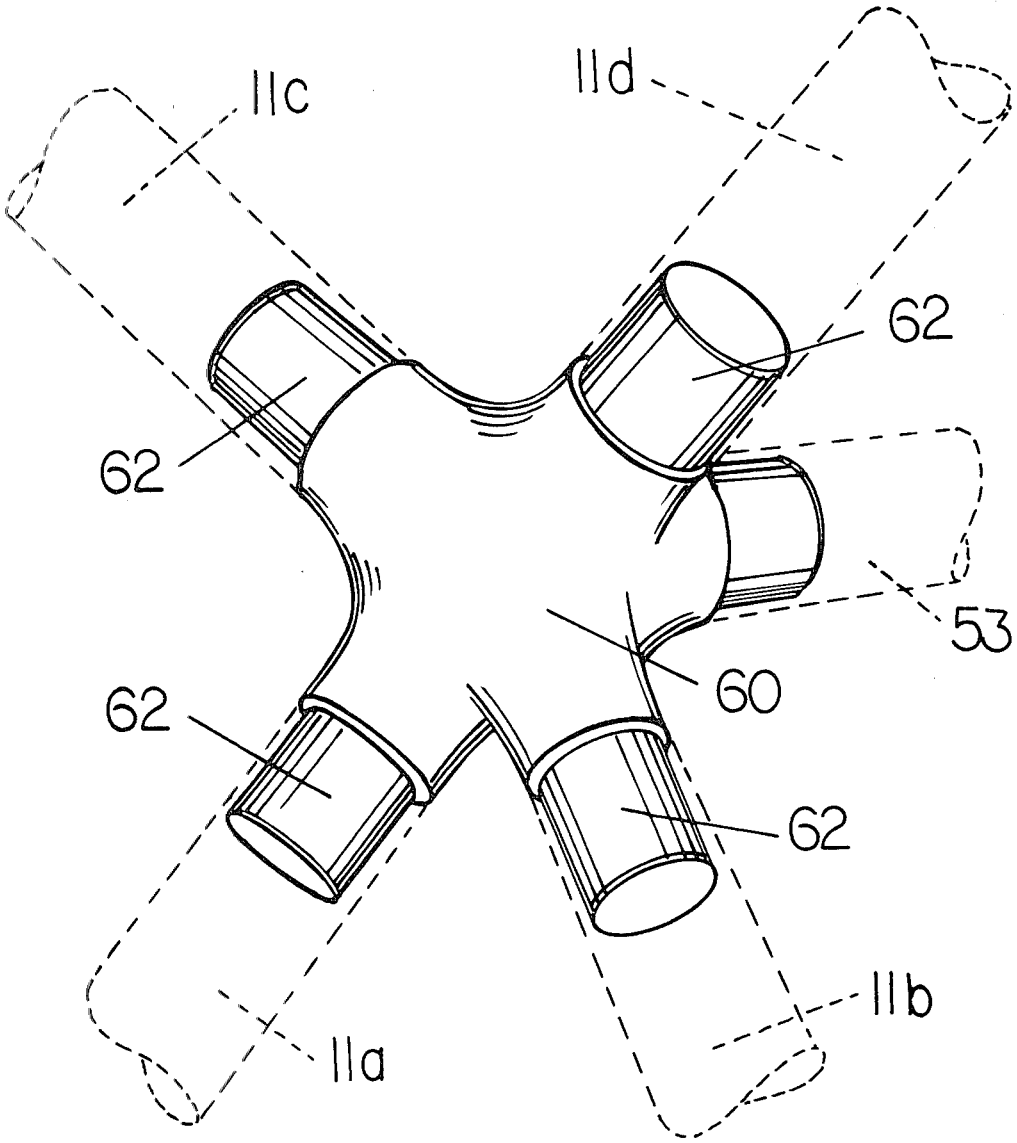
FIG. 13 shows a modified, semi-rigid joint.

In the above description the points of articulation are generally in the nature of hinges or pivotal joints. In a further form of the invention (FIG. 13), these joints could be made from semi-rigid castings (e.g. fiber-reinforced nylon or aluminum castings). These joints would then consist of a central piece 60 with a number of integral stubs 62 on which the struts 11*a*–11*d*, 53 would be detachably mounted. The term "articulation" as used herein is thus intended to cover fairly rigid joints in addition to movable joints.

What I claim is:

1. In a folding table or like structure having a generally planar table top supported on the floor by multiple legs, a support structure comprising:

(1) multiple points of articulation located below the table top at some distance inward from the edge of the table, at least two of said points being spaced apart from each other;

(2) two splayed legs in V-formation extending each from each point of articulation to points on the floor approximately vertically below the corners of the table top;

(3) a cable network interconnecting the lower ends of said legs and extending from each corner of the table top to the lower end of the leg located vertically below the respective corner;

the arrangement being such that in the assembled state all cables are in tension and the legs are in compression.

2. A folding table as claimed in claim 1, wherein the cable network interconnecting the lower ends of the legs forms a double Y with a central member having two ends and extending vertically below the longitudinal axis of the table top and two pairs of members diverging from the two ends respectively of the central member, which ends are disposed vertically below the two spaced articulation points respectively.

3. A folding table as claimed in claim 1, wherein the cable network interconnecting the lower ends of the legs forms a rectangle.

4. A folding table as claimed in claim 1, wherein the legs and the cables extending from each corner of the table to the lower end of the nearest leg form a series of triangles which give the table stability and eliminate wobble.

5. A folding table as claimed in claim 1, wherein the table top is a rectangular flexible solid and the points of articulation are located on the underside of the table top inward from the narrow ends of the table top by a distance which is approximately equal to one sixth of the total length of the table top.

6. A folding table as claimed in claim 1, wherein the table top is pre-formed with a slight camber so that when under stress the tension forces exerted by the vertical cables will cause the table top to assume an essentially flat configuration.

7. A folding table as claimed in claim 5, wherein the points of articulation on the underside of the table are arranged to be pushed away from each other and in this manner the cables are put under tension.

8. A folding table as claimed in claim 7, wherein the points of articulation slide in guides on the underside of the table top and are connected by a pair of hinged struts.

9. A folding table as claimed in claim 1, wherein the points of articulation are fixed on the underside of the table top and the structure is brought under tension by pulling the lower ends of the legs towards each other.

10. A folding table as claimed in claim 2, wherein the central member of the double Y-shaped cables interconnecting the lower ends of the legs includes a release means and spring means to apply tension to the cables and compensate for slight changes in lengths due to temperature differences.

11. A folding table comprising:

(1) a generally planar loosely supported rigid table top;

(2) two points of articulation located below the underside of the table top approximately midway between the plane of the table top and the floor;

(3) an upper and a lower pair of splayed legs in V-formation extending from each point of articulation; the ends of the lower legs resting on the floor and the ends of the upper legs supporting the table top;

(4) a generally horizontal bar extending between the points of articulation and generally parallel to the table top;

(5) lower cables interconnecting the lower ends of said legs, vertical cables extending generally from the upper ends of the upper legs to the lower leg ends of the lower legs; and upper cables interconnecting the upper ends of said legs.

(6) force release means to bring the cables under tension; the arrangement being such that in the assembled state all the cables are in tension and the legs are in compression.

12. A folding table as claimed in claim 11 comprising a third pair of splayed legs extending in V-formation from each point of articulation towards points of attachment substantially midway along the longer runs of the upper cables, and an additional set of cables extending from said midway points of attachment along the upper cables to a central meeting point of the lower cables located slightly above the level of the floor.

13. A folding table as claimed in claim 11, wherein the horizontal bar extending between the points of articulation is adjustable in length.

14. A folding table as claimed in claim 11, wherein the horizontal bar is in two pieces, one sliding telescopically within the other.

15. A folding structure for use as camping table or bed comprising:

(1) a generally rectangular top made from flexible material including canvas and other sheet material;

(2) two points of articulation located below the underside of the top approximately midway between the plane of the top and the ground;

(3) an upper and a lower pair of splayed legs in V-formation extending from each point of articulation; the ends of the lower legs resting on the ground and the ends of the upper legs engaging the top;

(4) a generally horizontal bar extending between the points of articulation and generally parallel to the top;

(5) lower cables interconnecting the lower ends of said legs and vertical cables extending from the upper ends of the upper legs to the lower ends of the lower legs; and upper cables interconnecting the upper ends of said legs;

(6) force release means to bring the cables under tension;

the arrangement being such that in the assembled state all the cables are in tension and the top is stretched drum tight between the upper ends of the upper pair of legs.

16. A folding structure as claimed in claim 15 comprising a third pair of splayed legs extending in V-formation from each point of articulation towards points of attachment substantially midway along the longer sides of the top.

17. A folding structure as claimed in claim 15, wherein the horizontal bar extending between the points of articulation is adjustable in length.

18. A folding structure as claimed in claim 17, wherein the horizontal bar is in two pieces, one sliding telescopically with the other.

19. A folding structure as claimed in claim 15, wherein the points of articulation are in the form of a semi-rigid body consisting of a central piece with a number of stubs on which the struts are detachably mounted.

* * * * *